United States Patent [19]

Heitmann

[11] 3,957,152

[45] May 18, 1976

[54] APPARATUS FOR CHANGING THE SPACING OF CIGARETTES OR THE LIKE

[75] Inventor: Bob Heitmann, Hamburg, Germany

[73] Assignee: Hauni-Werke Korber & Co., KG, Hamburg, Germany

[22] Filed: Sept. 5, 1974

[21] Appl. No.: 503,243

[30] Foreign Application Priority Data

Sept. 8, 1973 Germany ..... 2345475

[52] U.S. Cl. ..... 198/34; 198/20 C; 198/235

[51] Int. Cl.[2] ..... B65G 47/26

[58] Field of Search ..... 198/34, 31, 32, 39, 198/20 C, 235

[56] References Cited

UNITED STATES PATENTS

| | | | |
|---|---|---|---|
| 3,273,691 | 9/1966 | Griner | 198/34 |
| 3,405,579 | 10/1968 | London | 198/32 |
| 3,825,105 | 7/1974 | Cristoni | 198/20 C |

*Primary Examiner*—James B. Marbert
*Attorney, Agent, or Firm*—Peter K. Kontler; John Kurucz

[57] ABSTRACT

The spacing of cigarettes which are moved sideways in the flutes of two driven drum-shaped conveyors is changed during transfer of successive cigarettes from one of the conveyors whose flutes are spaced apart by a greater distance onto the other conveyor whose flutes are spaced apart by a lesser distance, or vice versa. The speed ratio of the conveyors is proportional to the ratio of the two distances and the configuration of flutes is such that they can bypass each other during travel past a transfer station at which successive flutes of the one conveyor are in temporary register with successive flutes of the other conveyor. The transfer takes place by suction, and the cigarettes are held by suction in those flutes which transport them toward the transfer station as well as in the flutes which transport them away from the transfer station.

15 Claims, 3 Drawing Figures

APPARATUS FOR CHANGING THE SPACING OF CIGARETTES OR THE LIKE

BACKGROUND OF THE INVENTION

The present invention relates to apparatus for changing the spacing of successive rod-shaped articles which form a row wherein the articles move sideways. More particularly, the invention relates to improvements in apparatus for changing the distances between plain or filter-tipped cigarillos, cigars or cigarettes or filter rod sections which are transported sideways between successive machines, for example, from a producing machine to a packing machine. The invention will be described primarily with reference to the making and treatment of filter cigarettes with the understanding, however, that the improved apparatus can be used with equal advantage in connection with all other types of rod-shaped smokers' articles or products regardless of whether such articles constitute portions of or entire smokers' products.

In a cigarette manufacturing plant wherein plain cigarettes are assembled with filter rod sections to form filter cigarettes, and wherein the filter cigarettes are transported to a packing machine to be introduced into soft or hard packs and thereupon into cartons, the plain cigarettes, filter rod sections and filter cigarettes are normally transported sideways in the form of one or more rows wherein the neighboring articles are spaced apart by predetermined distances. Such distances must be changed from time to time, for example during transport of filter cigarettes to a packing machine or during transport of filter rod sections from a magazine to the assembly conveyor of a filter cigarette making machine. The spacing of articles which move sideways is important for proper operation of subassemblies which receive and process such articles. Thus, whereas the filter cigarettes which are being tested in or downstream of a filter cigarette making machine are preferably spaced apart by relatively large distances to allow for longer-lasting testing of successive cigarettes and/or to prevent the ejection of satisfactory cigarettes which are immediately adjacent to defective cigarettes, it is desirable to introduce freshly tested cigarettes into the packing machine in the form of a row wherein neighboring cigarettes are immediately or closely adjacent to each other. The spacing of cigarettes or like rod-shaped articles which move sideways and the speed at which the articles are moved sideways are two important and often decisive factors for the success or failure of treatment to which the articles are subjected at different locations in a production line wherein shreds of tobacco leaves, cigarette paper webs, adhesive coated uniting bands, filter rod sections and packing materials are treated to form packs or cartons of rod-shaped smokers' products.

SUMMARY OF THE INVENTION

An object of the invention is to provide an apparatus which can change the spacing of rod-shaped articles without damaging or deforming the articles, which can be used to increase or reduce the spacing of articles, and which change the spacing while the articles are conveyed at a high speed, for example, at a speed corresponding to that at which plain or filter cigarettes issue from a cigarette rod making machine or a filter cigarette making machine.

Another object of the invention is to provide novel article receiving means for use in the improved apparatus.

A further object of the invention is to provide an apparatus which can be built into existing machines for the production of plain or filter-tipped cigarettes, cigars or cigarillos or filter rod sections with a minimum of cost for alterations and/or additional parts.

The improved apparatus is utilized for changing the spacing of rod-shaped articles which travel sideways, particularly for changing the distances between successive rod-shaped smokers' products which form a row. The apparatus comprises first and second series of first and second article receiving means wherein the neighboring receiving means are respectively spaced apart by larger first and smaller second distances, means for respectively moving the first and second series at first and second speeds along first and second paths and past a common transfer station at which successive first receiving means are in temporary register with successive second receiving means whereby the ratio of the first and second speeds corresponds (i.e., is proportional) to the ratio of the first and second distances, means for feeding articles into successive receiving means of one of the two series upstream of the transfer station, and means for transferring articles from successive receiving means of the one series into successive receiving means of the other series at the transfer station. The configuration of the receiving means of at least one series is such that the first receiving means can bypass the second receiving means and vice versa during movement past the transfer station.

The receiving means are preferably flutes and the two paths are preferably endless paths. The configuration of the first receiving means is preferably complementary to the configuration of that portion of the second path along which the articles in the second receiving means travel past the transfer station.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
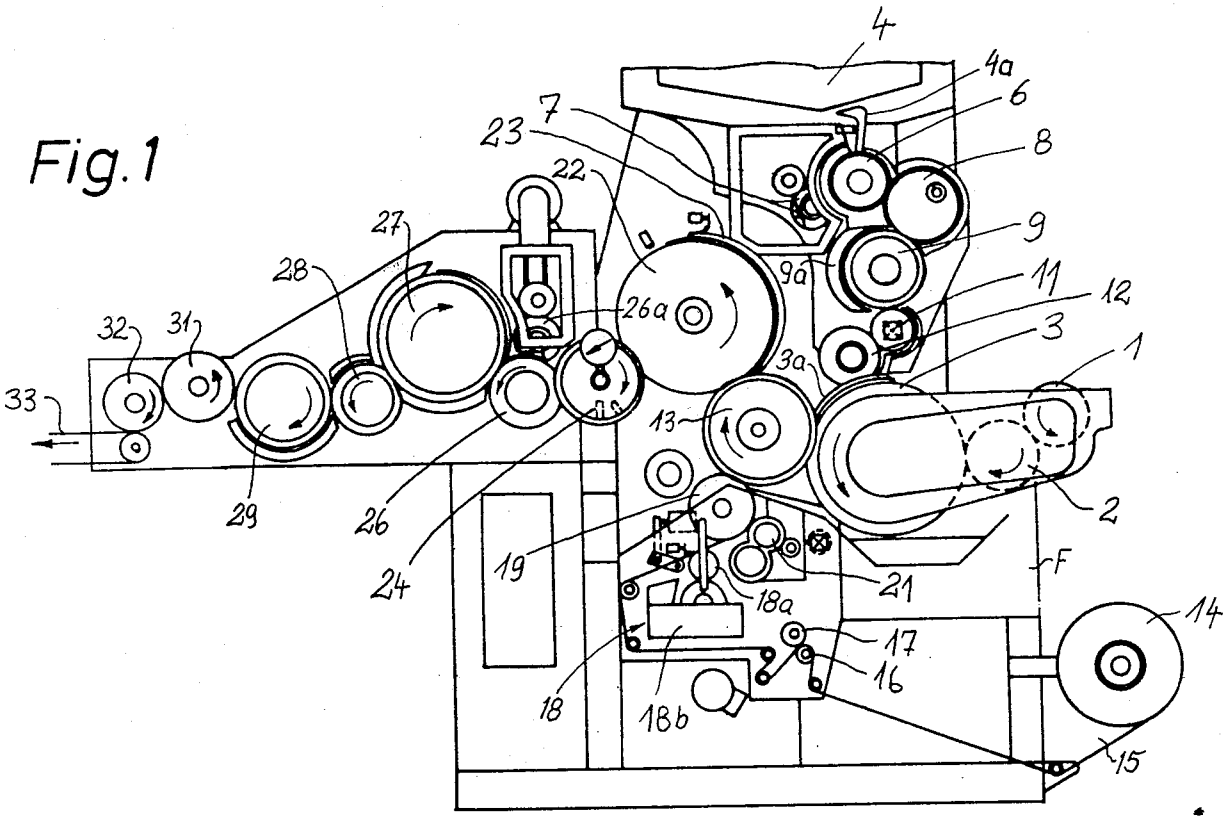
FIG. 1 is a schematic elevational view of a filter cigarette making machine including an apparatus which embodies one form of the invention.

FIG. 1 shows a filter cigarette making machine of the type known as MAX, produced by Hauni-Werke, Koerber & Co. K. G., of Hamburg-Bergedorf, Western Germany. The filter cigarette making machine is assumed to be directly coupled with a cigarette rod making machine (e.g., a machine of the type known as GARANT, also produced by Hauni-Werke) which comprises a drum-shaped transfer conveyor 1 having axially parallel peripheral receiving means or flutes each of which transports sideways a plain cigarette of unit length. The plain cigarettes in successive flutes are out of alignment with each other so that they form two rows of cigarettes wherein the cigarettes of one row are held in the first, third, etc. flutes and the cigarettes of the other row are held in the second, fourth, etc, flutes of the conveyor 1.

The filter cigarette making machine comprises a frame F which supports the aforementioned conveyor 1 and a pair of coaxial drum-shaped aligning conveyors 2 (only one shown) each of which serves to receive and transport one of the two rows of plain cigarettes supplied by the transfer conveyor 1. One of the aligning conveyors 2 travels at a different speed than the other aligning conveyor, or one of these conveyors transports the plain cigarettes of the respective row through a different distance so that each plain cigarette of one row is aligned with a plain cigarette of the other row before the thus obtained pairs of plain cigarettes are transferred into successive flutes of a drum-shaped assembly conveyor 3. The plain cigarettes of each pair of cigarettes on the assembly conveyor 3 are spaced apart by distances which at least equal but preferably slightly exceed the length of a filter rod section of double unit length.

The frame F of the filter cigarette making machine supports a magazine or hopper 4 for a supply of parallel filter rod sections of six times unit length. The lower portion of the magazine 4 communicates with a downwardly inclined chute 4*a* which feeds descrete filter rod sections of six times unit length into successive flutes of a drum-shaped severing conveyor 6 cooperating with two rapidly rotating disk-shaped knives 7 to subdivide each filter rod section of six times unit length into a group of three coaxial filter rod sections of two times unit length. Each filter rod section of a group of three filter rod sections of double unit length is accepted by a discrete drum-shaped staggering conveyor 8 (only one shown). The conveyors 8 travel at different speeds and/or transport the respective filter rod sections of double unit length through different distances so as to insure that each group of three coaxial filter rod sections is converted into a series of three filter rod sections which are located one behind the other, as considered in the circumferential direction of the staggering conveyor 8 shown in FIG. 1. Successive filter rod sections of double unit length are inserted into successive flutes of a drum-shaped shuffling conveyor 9 which cooperates with two stationary cams 9*a* to shift certain filter rod sections of double unit length in order to form a single row of such filter rod sections wherein each preceding section is in exact alignment with the next-following section. The flutes of the shuffling conveyor 9 introduce successive filter rod sections of double unit length into successive flutes of a drum-shaped transfer conveyor 11 which introduces the filter rod sections into successive flutes of a drum-shaped accelerating conveyor 12. The latter inserts successive filter rod sections of double unit length into the gaps between pairs of aligned plain cigarettes of unit length in successive flutes of the assembly conveyor 3.

The assembly conveyor 3 cooperates with two stationary cams 3*a* which cause the plain cigarettes of each pair to move toward each other so that their inner end faces abut against the adjacent end faces of the respective filter rod section of double unit length. The thus obtained groups of three coaxial rod-shaped articles (each group consists of two plain cigarettes and a filter rod section therebetween) are thereupon introduced into successive flutes of a drum-shaped transfer conveyor 13.

The frame F further supports a bobbin 14 consisting of a web 15 of convoluted cigarette paper or cork which is being withdrawn by two advancing rolls 16, 17 and is caused to move into contact with a rotary roller-shaped applicator 18*a* forming part of a paster 18 wherein a tank 18*b* contains a supply of suitable adhesive. The applicator 18*a* provides the underside of the web 15 with a film of adhesive and the leader of the adhesive-coated web is caused to adhere to the ported peripheral surface of a rotating suction drum 19 which is adjacent to the transfer conveyor 13. The suction drum 19 cooperates with a rotary knife 21 which severs the leader of the web 15 at regular intervals to form a succession of adhesive-coated uniting bands which are caused to adhere to successive groups in the flutes of the transfer conveyor 13 in such a way that each uniting band contacts an entire filter rod section of double unit length and the inner end portions of the respective plain cigarettes of unit length.

The conveyor 13 transfers successive groups (each of which carries an adhesive-coated uniting band) onto a wrapping conveyor 22 which cooperates with a stationary or mobile rolling device 23 to cause the groups to roll about their respective axes and to thus convert the uniting bands into tubes which surround the corresponding filter rod sections of double unit length and the adjacent inner end portions of the respective plain cigarettes of unit length. Thus, each such group is converted into a filter cigarette of double unit length, and the filter cigarettes of double unit length are thereupon transferred into the flutes of a drum-shaped conveyor 24 forming part of a testing unit wherein the filter cigarettes of double unit length are examined for the condition of their wrappers. Satisfactory filter cigarettes of double unit length are permitted to reach a rotary drum-shaped severing conveyor 26 which cooperates with a rotary disk-shaped knife 26*a* to sever each filter cigarette of double unit length midway between its ends so that each such cigarette yields a pair of coaxial filter cigarettes 52 (see FIG. 2) of unit length. The pairs of filter cigarettes of unit length are transferred onto a rotary inverting conveyor 27 which inverts one filter cigarette of each pair end-for-end and preferably places the inverted cigarette into the space between the adjacent pair of non-inverted cigarettes so that all filter cigarettes form a single row wherein all of the filter rod sections of unit length (the knife 26*a* severs successive filter cigarettes of double unit length midway across the filter rod sections of double unit length) face in the same direction.

The single row of filter cigarettes of unit length is accepted by a rotary drum-shaped transfer conveyor 28 which introduces them into successive receiving means or flutes 29*a* (see FIG. 2) of a testing conveyor 29 whereon the tobacco-containing ends of the cigarettes 52 are examined to determine the density of tobacco therein. The conveyor 29 serves as a means for feeding satisfactory filter cigarettes 52 of unit length into successive receiving means or flutes 51 of a further drum-shaped conveyor 31 which cooperates with a drum-shaped conveyor 32 to reduce the spacing of filter cigarettes 52 and thereupon deposits the cigarettes onto the upper stretch of an endless conveyor belt 33 serving to transport satisfactory filter cigarettes of unit length into storage, to a tray filling device, to a pneumatic sender, or directly into a packing machine, not shown.

Figure 2:
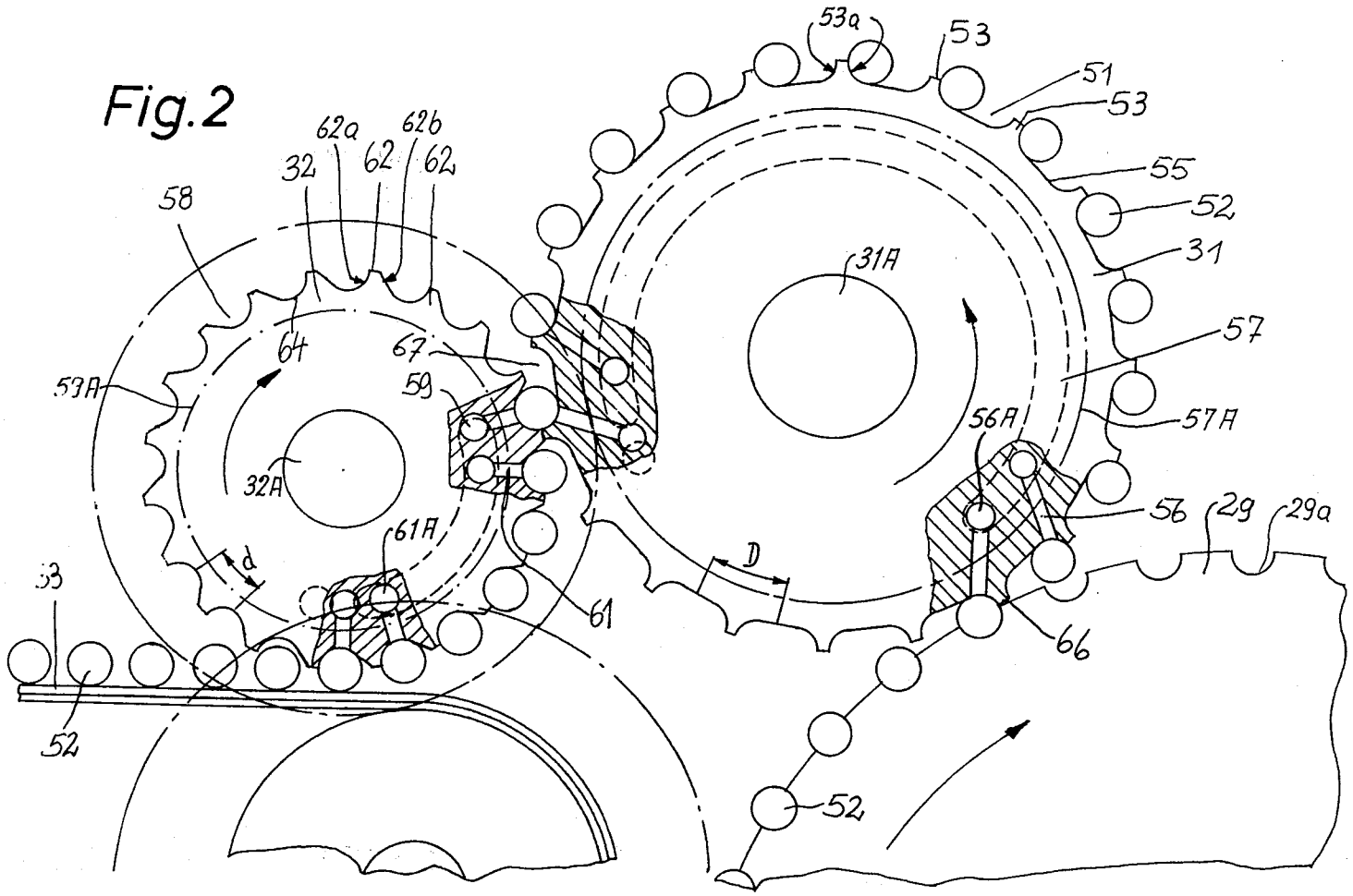
FIG. 2 is an enlarged partly elevational and partly sectional view of the apparatus.

FIG. 2 shows that the flutes 51 form a first series or succession of receiving means and are moved along a first endless path by the drum-shaped body of the conveyor 31 (this conveyor receives motion from a first drive shaft 31A). The flutes 58 of the conveyor 32 form a second series or succession of receiving means for cigarettes 52 and are moved along a second endless path by the drum-shaped body of the conveyor 32 which is rotated by a second drive shaft 32A. The transfer station at which successive flutes 51 deliver filter cigarettes 52 into successive flutes 58 is shown at 67, and the transfer station at which successive flutes 29*a* of the feeding conveyor 29 deliver cigarettes 52 into successive flutes 51 of the conveyor 31 is shown at 66. The conveyors 29 and 32 rotate clockwise, and the conveyor 31 rotates counterclockwise, as viewed in FIG. 1 or 2. The distance D between the centers of two neighboring flutes 51 on the conveyor 31 exceeds the distance *d* between the centers of two neighboring flutes 58 on the conveyor 32. The ratio of peripheral speeds of the conveyors 31, 32 (i.e., of the speeds at which the flutes 51 and 58 move along the respective endless paths) is identical with or closely approximates the ratio of the distance D and *d*, i.e., the peripheral speed of the conveyor 31 exceeds the peripheral speed of the conveyor 32 and, owing to the aforementioned ratio, successive flutes 51 are in temporary register with successive flutes 58 during travel past the transfer station 67. The peripheral speed of the conveyor 29 equals the peripheral speed of the conveyor 31 if the distance between the centers of two neighboring flutes 29*a* equals D.

The flutes 29*a* are parallel to the axis of the conveyor 29, and the flutes 51 and 58 are respectively parallel to the axes of the shafts 31A and 32A.

FIG. 2 shows that the width of each flute 51, as considered in the circumferential direction of the conveyor 31, exceeds the diameter of a filter cigarette 52 of unit length. Each of these flutes is assumed to extend all the way from the one to the other end face of the drum-shaped body of the conveyor 31; this also applies for the flutes 58 and the drum-shaped body of the conveyor 32. Each flute 51 extends between a front rib or land 53 and a rear land or rib 53 of the conveyor 31. The land 53 at the rear end of a flute 51 constitutes the land in front of the next-following flute. Each land 53 is flanked by two concave surfaces 53*a* whose radii of curvature preferably equal or closely approximate the radius of a filter cigarette 52. The profile of each concave surface 53*a* preferably equals one-fourth of a circle having a diameter equal to that of a cigarette 52. The surface 55 at the bottom of each flute 51 is flat or its configuration (curvature) is complementary to that of the path along which the cigarettes 52 in flutes 58 of the conveyor 32 move past the transfer station 67. The transition between the bottom surface 55 and the respective concave surface 53*a* is preferably gradual. FIG. 2 shows that the height of each land 53 (as considered radially of the conveyor 31) equals or closely approximates the radius of a cigarette 52. In the embodiment of FIG. 2, the bottom surfaces 55 of the flutes 51 are flat, and each such surface is normal to a radius which extends from the axis of the shaft 31A to a point midway between the respective lands 53. As stated before, the bottom surfaces 55 may have a more complex profile, e.g., a curved profile corresponding to that portion of the path for cigarettes 52 wherein the cigarettes travel past the station 67 upon completed transfer from a flute 51 into the registering flute 58. In each instance, the depth of the central portion of each flute 51 (midway between the respective lands 53) exceeds the depth in regions which are adjacent to the nearest concave surfaces 53*a*. The width of the flutes 51 (as considered in the circumferential direction of the conveyor 31) depends primarily on the distances *d* (i.e., on the spacing of the axes of cigarettes 52 in two neighboring flutes 58 of the conveyor 32) and also on the ratio D:*d*. The width of the flutes 51 increases with increasing ratio D:*d*. Such width must be sufficient to insure that a cigarette 52 which reaches the transfer station 67 by moving in a flute 51 can be transferred into the registering flute 58 without touching the next-following land 53 of the conveyor 31 (whose peripheral speed exceeds that of the conveyor 32).

The means for retaining the cigarettes 52 in flutes 51 of the conveyor 31 comprises a suction generating device (e.g., a fan, not shown) which is connected to an arcuate groove 57 in a stationary valve plate 57A. The latter is immediately adjacent to the rear end face of the drum-shaped body of the conveyor 31 and its groove 57 communicates with certain channels 56A of an annulus of such channels which are machined into the body of the conveyor 31 and extend in parallelism with the shaft 31A. Each channel 56A is a blind bore having its open end in that end face of the drum-shaped body of the conveyor 31 which abuts against the grooved surface of the valve plates 57A. The retaining means for cigarettes 52 in the flutes 51 further comprises a plurality of suction ports 56, at least one for each flute 51. Each port 56 connects a flute 51 with one of the channels 56A and hence with the suction inlet of the fan. The groove 57 extends from the transfer station 66 to the transfer station 67 so that the ports 56 can retain those cigarettes 52 which are delivered to successive flutes 51 by successive flutes 29*a* and which thereupon travel toward the transfer station 67 between the conveyors 31 and 32. The feeding conveyor 29 is preferably associated with a valve plate, not shown, and has suction ports which retain cigarettes 52 in the flutes 29*a* during travel of cigarettes from the transfer station between the conveyors 28, 29 (see FIG. 1) to the transfer station 66. Each port 56 is preferably inclined outwardly and rearwardly, as considered in the direction of rotation of the conveyor 31, i.e., each port 56 extends inwardly from the respective flute 51 and forwardly, as considered in the aforementioned direction. FIG. 2 further shows that the outer end of each port 56 communicates with the front end of the respective flute 51, i.e., that the ports 56 extend inwardly from the rear surfaces 53*a* of the front lands 53 of the successive flutes 51. This insures that the streamlets of air rushing into the ports 56 which reach the transfer station 66 cause the respective cigarettes 52 to come to rest in the foremost portions of the respective flutes 51. Such positioning of cigarettes 52 in the flutes 51 reduces the likelihood of damage to or deformation of cigarettes during transfer into the flutes 58 of the conveyor 32. The feature that the ports 56 are inclined forwardly and inwardly of the respective flutes 51 contributes to automatic transport of cigarettes 52 into the foremost portions of those flutes 51 which reach the transfer station 66.

The means for retaining cigarettes 52 in the flutes 58 of the conveyor 32 comprises a suction generating device (e.g., the aforementioned fan which is connected with the groove 57 of the valve plate 57A) which is connected with the arcuate groove 59 of a second stationary valve plate 59A. The latter abuts against the rear end face of the drum-shaped body of the conveyor 32 and its groove 59 extends from the transfer station 67 to a transfer station where the cigarettes 52 descend onto the upper stretch of the conveyor belt 33. Each flute 58 communicates with at least one substantially radially extending port 61, and the inner end of each port 61 communicates with a discrete channel or blind bore 61A which is machined into the body of the conveyor 32 and has an open end in register with the groove 59 during travel from the transfer station 67 toward the upper stretch of the conveyor belt 33.

The flutes 58 of the conveyor 32 are separated from each other by ribs or lands 62. It will be noted that the radius of curvature of the rear concave surface 62*a* of each land 62 is smaller than the radius of curvature of the substantially concave surface 62*b* at the front side of each land 62. The radius of curvature of each surface 62*a* preferably equals or closely approximates the radius of a cigarette 52. A cigarette 52 which has been transferred into a flute 58 comes to rest in the deepmost portion 64 of such flute and is retained therein by suction in the respective port or ports 61. It will be noted that a port 61 which arrives at the transfer station 67 constitutes a means for transferring a cigarette from the adjacent flute 51 into the respective flute 58. It is clear, however, that the transferring means may further include or be replaced by mechanical transferring means in the form of shrouds or the like, not shown. The curvature of the surface bounding the deepmost portion 64 of each flute 58 preferably matches the curvature of the wrapper of the cigarette 52 in such flute. Each port 61 communicates with the deepmost portion 64 of the respective flute 58.

The operation of the apparatus of FIG. 2 is as follows:

The spacing of neighboring cigarettes 52 in the flutes 29*a* of the feeding conveyor 29 is constant; such spacing is assumed to equal the distance D between the centers of neighboring flutes 51 on the conveyor 31. The distance D is selected with a view to insure an optimum operation of the testing unit including the conveyor 29, and the distance *d* between the centers of neighboring flutes 58 on the conveyor 32 is selected with a view to insure an optimum spacing of cigarettes 52 on the upper stretch of the conveyor belt 33 which is assumed to transport cigarettes directly to a packing machine. When a flute 29*a* reaches the transfer station 66, the cigarette 52 therein is attracted by suction in the oncoming port or ports 56 of a flute 51 so that the cigarette enters the flute 51 and is caused to come to rest in the foremost portion of such flute, i.e., it abuts against the rear concave surface 53*a* of the front land 53. The peripheral speed of the conveyor 29 equals the peripheral speed of the conveyor 31 so that there is ample time for satisfactory transfer of cigarettes 52 into the flutes 51 even if the conveyors 29 and 31 are driven at a high speed. The groove of the valve plate (not shown) which is associated with the conveyor 29 terminates at the transfer station 66 so that the ports of flutes 29*a* cannot interfere with the transfer of cigarettes 52 into the registering flutes 51.

The spacing of cigarettes 52 is reduced automatically during transfer from the flutes 51 into the registering flutes 58 at the station 67. The peripheral speed of the conveyor 32 is less than that of the conveyor 31 so that each flute 51 which reaches the transfer station 67 travels faster than the adjacent flute 58. However, and since the width of each flute 51 (as considered in the circumferential direction of the conveyor 31) exceeds the diameter of the cigarette 52, a cigarette which has been transferred into the adjacent flute 58 and comes to rest in the deepmost portion 64 thereof has ample time to advance in a clockwise direction to the extent which is necessary to insure that such cigarette can be bypassed by the oncoming land 53, namely, by the land 53 located behind that flute 51 which has been relieved of a cigarette 52 at the transfer station 67. The aforementioned configuration of the bottom surfaces 55 of flutes 51 also contributes to gentle transfer of cigarettes into the flutes 58 because, as a cigarette enters the deepmost portion 64 of the flute 58 at the station 67 and the freshly emptied flute 51 begins to move relative to such cigarette, the deepmost portion of the flute 51 (midway between the respective lands 53) can readily bypass the cigarette in the flute 58 in spite of the fact that the speed of the flute 51 exceeds the speed of the flute 58. If the ratio of the speeds of the shafts 31A and 32A is high, the ratio of the distances D and *d* is also high, and the spacing of cigarettes in the flutes 58 of the conveyor 32 is substantially less than the spacing of cigarettes in the flutes 51 of the conveyor 31. As mentioned above, the width of the flutes 51 is also proportional to the radio D:*d* because it is desirable to employ relatively wide flutes 51 if the peripheral speed of the conveyor 31 greatly exceeds the peripheral speed of the conveyor 32; this insures that the lands 53 at the rear ends of freshly emptied flutes 51 cannot engage and deform or destroy the freshly transferred cigarettes 52 while such cigarettes dwell in the deepmost portions 64 of the respective flutes 58 and travel therewith toward the upper stretch of the conveyor belt 33.

The configuration of surfaces 62*a* and 62*b* on the lands 62 between the flutes 58 of the conveyor 32 also contributes to satisfactory transfer of cigarettes 52 at the station 67. Such configuration, together with the aforediscussed configuration of flutes 51, height of lands 53 and curvature of the concave surfaces 53*a*, insures that empty flutes 51 can bypass freshly filled flutes 58 and that the lands 53 cannot touch the cigarettes in the flutes 58.

The feature that the radius of curvature of each surface 62*a* is smaller than the radius of curvature of each surface 62*b* is particularly desirable if the movements of conveyors 31, 32 are not synchronized with a maximum degree of accuracy. In the absence of accurate synchronization, and assuming that the radius of curvature of each surface 62*b* were identical with the radius of curvature of each surface 62*a* (i.e., with the radius of a cigarette 52), the rear land of an oncoming flute 58 would be likely to squash a cigarette at the transfer station 67.

The groove 57 ends at the transfer station 67, and the groove 59 begins at this station; therefore, the ports 61 which reach the station 67 automatically remove cigarettes 52 from the adjacent flutes 51 and cause the withdrawn cigarettes to enter the deepmost portions 64 of the respective flutes 58.

The groove 59 ends substantially at the six O'clock position of the conveyor 32. Therefore, a cigarette 52 which approaches the upper stretch of the conveyor belt 33 is not attracted by suction and can descend by gravity. The direction of rotation of the drum-shaped body of the convveyor 32 and the direction of movement of the upper stretch of the conveyor belt 33 are selected in such a way that the direction of the velocity vector of a cigarette 52 which has been released from the respective flute 58 is the same as that of the belt 33. Therefore, the spacing of cigarettes 52 which travel with the conveyor belt 33 is identical or nearly identical with the spacing of cigarettes in the flutes 58 of the conveyor 32. This is due to the fact that the relative velocity between cigarettes 52 which leave the flutes 58 and the upper stretch of the conveyor belt 33 is zero or practically zero. Moreover, such mode of transferring cigarettes 52 onto the conveyor belt 33 reduces the likelihood of misalignment of cigarettes during transport away from the transfer station between 32 and 33. This is particularly desirable when the cigarettes are transported directly into a packing machine.

As mentioned above, the bottom surface 55 of each flute 51 may be a curbed surface; in such apparatus, the curvature of each surface 55 preferably equals the curvature of that portion of the path for cigarettes 52 in which the cigarettes travel immediately following their transfer into the flutes 58 of the conveyor 32. Flat surfaces 55 which are normal to the radii extending from the axis of the shaft 31A to the centers of the respective flutes 51 are preferred at this time because they can be machined at a lower cost. Morever, such flat surfaces are just as effective as the aforementioned curved surfaces because the depth of the flutes 51 increases in a direction from the front land 53 toward the center of each flute which insures that the flutes 51 and lands 53 can bypass the lands 62 and cigarettes 52 in flutes 58 during travel past the station 67.

Figure 3:
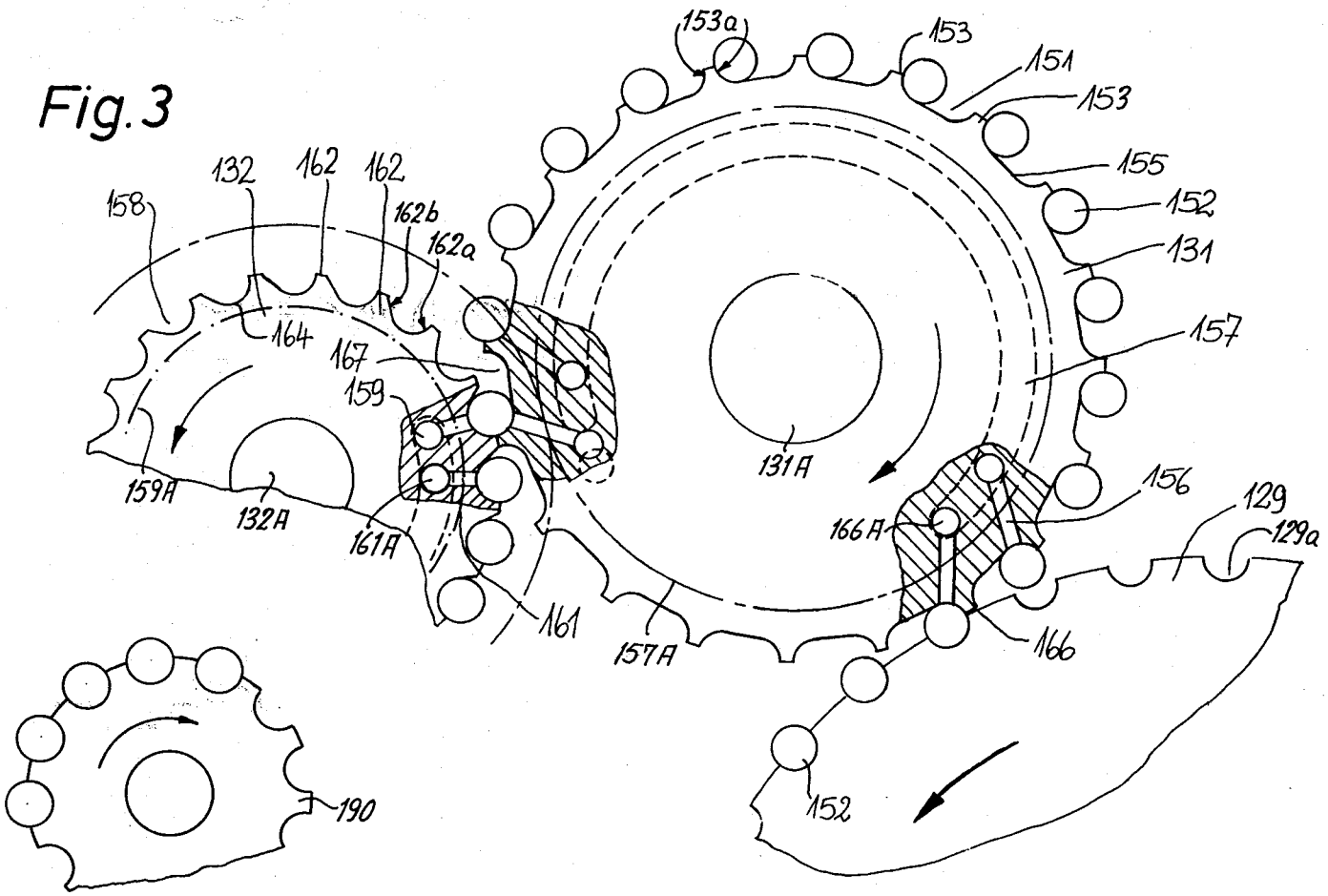
FIG. 3 is a similar view of a modified apparatus.

The apparatus of FIG. 3 serves to increase the spacing of cigarettes 152 during transfer from the flutes 158 of the conveyor 132 into the flutes 151 of the conveyor 31. A feeding conveyor which delivers cigarettes 152 into successive flutes 158 upstream of the transfer station 167 is shown at 190. The conveyor 129 of FIG. 3 serves to receive cigarettes 152 from the flutes 151 of the conveyor 131. All such parts of the apparatus of FIG. 3 which are identical with or clearly analogous to the corresponding parts of the apparatus of FIG. 2 are denoted by similar reference characters plus 100. Thus each flute 151 is flanked by two lands or ribs 153, each flute 158 is flanked by two lands or ribs 162, and the conveyors 131, 132 respectively cooperate with fixedly mounted valve plates 157A and 159A. The conveyors 132, 129 are driven to rotate counterclockwise, and the conveyors 190, 131 are driven to rotate clockwise, as viewed in FIG. 3.

It will be noted that, in FIG. 3 the concave or flate surfaces **162*b* (larger radii of curvature) are located at the front ends and the concave surfaces 162*a* (smaller radii of curvature) are located at the trailing ends of the respective flutes 158. The reason for this will be readily appreciated by considering the rearmost cigarette 152 on the conveyor 151; were the radius of curvature of the adjacent surface 162*b* smaller, the respective land 162 would be likely to damage or destroy the cigarette, especially in the absence of proper relationship between the speeds of the conveyor 131 and 132**.

During travel with the conveyor 131, the cigarettes 152 dwell in the rearmost portions of the respective flutes 151. Therefore, the suction ports 156 communicate with the concave front surfaces **153*a* of the rear lands 153. At the transfer station 167, a cigarette 152 is withdrawn from its flute 158 by suction in the oncoming port 156 and travels rearwardly toward the front surface 153*a* of the respective rear land 153. This reduces the likelihood of contact between the transferred cigarette 152 and the adjacent land 162 of the conveyor 132**.

It is clear that the improved apparatus is susceptible of many further modifications. For example, the conveyor 31, 32, 131 and/or 132 need not be a drum but may constitute a chain, an endless fluted belt or the like. Drum-shaped conveyors are preferred at this time because their space requirements are less than those of other types of conveyors.

An important advantage of the improved apparatus is that it can be used to change the spacing of cigarettes within a wide range by the simple expedient of properly selecting the configuration and width of flutes on the conveyors 31, 32 or or 132, 131. In fact, and referring again to FIG. 2, the apparatus which is shown therein can be used to reduce the spacing of cigarettes 52 on the conveyor belt 33 to zero or substantially to zero so that the belt 33 need not be provided with cradles, grooves or analogous means for insuring accurate spacing of and exact parallelism between cigarettes which travel toward the packing machine. Analogously, the conveyor 190 of FIG. 3 can be replaced with a belt conveyor having an upper stretch which transports cigarettes 152 in such a way that the neighboring cigarettes touch or almost touch each other.

Another important advantage of the improved apparatus is that the spacing can be increased or reduced without any damage to and/or lasting deformation of cigarettes 52 or 152. Also, the transfer takes place in such a way that the tobacco-containing ends of cigarettes 52 or 152 are not likely to lose tobacco shreds, i.e., without adversely affecting the density of the tobacco-containing ends. In fact, and as explained above, a cigarette 52 or 152 which has been transferred into a flute 58 or 151 need not and normally is not touched by any part or parts of the conveyor 31 or 132.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptions should and are intended to be comprehended within the meaning and range of equivalence of the claims.

What is claimed as new and desired to be protected by Letters Patent is set forth in the appended claims:

1. Apparatus for changing the spacing of rod-shaped articles which travel sideways, particularly for changing the spacing between successive rod-shaped smokers' products which form a row, comprising first and second series of first and second article receiving means wherein the neighboring receiving means are respectively spaced apart by larger first and smaller second distances; means for respectively moving said first and second series at first and second speeds along first anbd second paths and past a common transfer station at which successive first receiving means are in temporary register with successive second receiving means, the ratio of said first and second speeds being proportional to the ratio of said first and second distances, means for feeding articles into successive receiving means of one of said series ahead of said transfer station; and means for transferring articles from successive receiving means of said one series directly into successive receiving means of the other of said series at said station, the configuration of receiving means of at least one of said series being such that said first receiving means can bypass transferred articles in said second receiving means and vice versa during movement past said transfer station.

2. Apparatus as defined in claim 1, wherein said receiving means are flutes and said paths are endless paths, portions of said first receiving means having configurations which are complementary to the configuration of that portion of said second path along which the articles in said second receiving means travel past said transfer station.

3. Apparatus as defined in claim 1, wherein the receiving means having said configuration are the receiving means of said second series.

4. Apparatus as defined in claim 1, wherein said one series is said first series and each of said second receiving means is a flute.

5. Apparatus as defined in claim 4, wherein each of said flutes is bounded by a composite concave surface having a front portion and a rear portion, as considered in the direction of movement of said flutes along said second path, the radii of curvature of said front portions being smaller than the radii of curvature of said rear portions of said composite surfaces.

6. Apparatus as defined in claim 1, wherein said one series is said second series and said second receiving means are flutes.

7. Apparatus as defined in claim 6, wherein each of said flutes is bounded by a composite concave surface having a front portion and a rear portion, as considered in the direction of movement of said flutes along said second path, the radii of curvature of said front portions being greater than the radii of curvature of said rear portions of said surfaces.

8. Apparatus as defined in claim 1, wherein each of said moving means comprises a rotary conveyor having a peripheral surface and said first and second receiving means are flutes provided in the peripheral surfaces of the respective conveyors and parallel to the axes of the respective conveyors.

9. Apparatus as defined in claim 1, wherein said moving means for said one series comprises means for retaining articles in the receiving means of said one series upstream of said station and said moving means for said other series comprises means for retaining articles in the receiving means of said other series downstream of said station.

10. Apparatus as defined in claim 9, wherein said retaining means includes suction generating means and ports communicating with said suction generating means and with said receiving means.

11. Apparatus as defined in claim 10, wherein said first receiving means are flutes having front and rear portions as considered in the direction of movement of said flutes along said first path, those ports which communicate with said first receiving means being in communication with the front portions of said flutes.

12. Apparatus as defined in claim 11, wherein said front portions of said flutes are bounded by concave surfaces having radii of curvature corresponding to the radii of rodshaped articles therein and said ports are arranged to attract the articles against said concave surfaces during travel of articles in the flutes of said first series.

13. Apparatus as defined in claim 12, wherein said means for moving said first series comprises a rotary conveyor having a peripheral surface and said flutes are provided in said peripheral surface and extend in parallelism with the axis of said conveyor, said ports being provided in said conveyor and extending inwardly from the respective flutes, each of said ports being inclined outwardly and rearwardly, as considered in the direction of rotation of said conveyor.

14. Apparatus as defined in claim 1, wherein said first receiving means are flutes each bounded by a composite surface having concave front and rear portions, as considered in the direction of movement of said flutes along said first path, and a substantially flat median portion.

15. Apparatus as defined in claim 1, wherein said means for moving said first series includes a rotary conveyor having a peripheral surface and said first receiving means are flutes provided in said peripheral surface and extending in parallelism with the axis of said conveyor, each of said flutes being bounded by a surface having concave front and rear portions, as considered in the direction of rotation of said conveyor and a flat median portion which is normal to a radius extending from said axis to the center of the respective flute.

* * * * *